US007655852B2

(12) United States Patent
Sullivan

(10) Patent No.: US 7,655,852 B2
(45) Date of Patent: Feb. 2, 2010

(54) SINGLE REED WOODWIND MUSICAL INSTRUMENT MOUTHPIECE APPARATUS AND METHOD

(76) Inventor: George V. Sullivan, P.O. Box 950, Avon, CT (US) 08001

( * ) Notice: Subject to any disclaimer, the term of this patent is extended or adjusted under 35 U.S.C. 154(b) by 0 days.

(21) Appl. No.: 11/828,615

(22) Filed: Jul. 26, 2007

(65) Prior Publication Data

US 2008/0022839 A1 Jan. 31, 2008

Related U.S. Application Data

(60) Provisional application No. 60/833,650, filed on Jul. 27, 2006, provisional application No. 60/924,291, filed on May 7, 2007.

(51) Int. Cl.
*G10D 9/02* (2006.01)

(52) U.S. Cl. ..... 84/383 R; 84/383 A

(58) Field of Classification Search ..... 84/383 R, 84/383 A

See application file for complete search history.

(56) References Cited

U.S. PATENT DOCUMENTS 1,525,105 A * 2/1925 Sinclair ..... 84/383 R
1,748,077 A * 2/1930 Packman et al. ..... 84/383 R
2,467,921 A * 4/1949 Werner ..... 84/383 R
2,496,749 A * 2/1950 Reddick ..... 84/383 R
2,499,855 A * 3/1950 Gamble ..... 84/383 R
2,719,688 A * 10/1955 Seifert ..... 248/188.5
3,205,753 A * 9/1965 Luyben ..... 84/383 R
3,413,884 A * 12/1968 Sciacca ..... 84/383 R
3,618,440 A * 11/1971 Ratterree ..... 84/173
3,890,873 A * 6/1975 Harrison ..... 84/383 R
4,079,978 A * 3/1978 McMullin ..... 294/19.1
4,210,055 A * 7/1980 Platamone, Jr. ..... 84/383 R
4,372,190 A * 2/1983 McGuerty ..... 84/383 R
4,385,849 A * 5/1983 Crain ..... 403/109.3
4,428,271 A * 1/1984 Winslow et al. ..... 84/383 R
4,517,875 A * 5/1985 Dossekker ..... 84/383 R
4,596,175 A * 6/1986 Dossekker ..... 84/383 R
4,605,378 A * 8/1986 Hamilton ..... 440/102
4,711,595 A * 12/1987 Magid et al. ..... 403/108
4,745,838 A * 5/1988 Johnson ..... 84/383 R
4,941,385 A * 7/1990 Johnson ..... 84/383 R
5,000,073 A * 3/1991 Hite ..... 84/383 R
5,139,040 A * 8/1992 Kelly ..... 135/69
5,289,753 A * 3/1994 Rieckhoff ..... 84/383 R (Continued)

*Primary Examiner*—Jeffrey Donels
*Assistant Examiner*—Robert W Horn
(74) *Attorney, Agent, or Firm*—Sperry, Zoda & Kane

(57) ABSTRACT

A mouthpiece assembly for a woodwind musical instrument that holds an associated reed includes (1) an elongated mouthpiece body defining an air conduit means extending therethrough for providing a supply of air to facilitate playing of a woodwind musical instrument; (2) a reed placement surface defined on the mouthpiece body adjacent the air conduit dimensioned and configured to receive a reed detachably secured thereagainst; (3) a ligature including a ligature body dimensioned and configured to encircle the mouthpiece body and selectively retain the associated reed in position upon the reed placement surface and (4) a locating body engaging the ligature body and the mouthpiece body to locate the ligature body axially and radially with respect the mouthpiece body. The invention also includes the method for mounting a ligature on a mouthpiece for a woodwind musical instrument that includes the step of providing a locating body engaging the ligature body and the mouthpiece body to locate the ligature body axially and radially with respect the mouthpiece body.

15 Claims, 5 Drawing Sheets

U.S. PATENT DOCUMENTS 5,419,229 A * 5/1995 Van Doren ..... 84/383 R
5,440,962 A * 8/1995 Valtchev ..... 84/383 R
5,593,196 A * 1/1997 Baum et al. ..... 294/19.1
5,630,381 A * 5/1997 Kroyer ..... 119/801
D390,249 S * 2/1998 Smith ..... D17/13
5,728,957 A * 3/1998 Valtchev ..... 84/383 R
5,929,353 A * 7/1999 Taninbaum ..... 84/380 R
5,973,245 A * 10/1999 Van Doren ..... 84/383 R
6,079,894 A * 6/2000 Obitts ..... 403/109.3
6,213,672 B1 * 4/2001 Varga ..... 403/109.2
6,263,895 B1 * 7/2001 Bang ..... 135/138
6,343,890 B1 * 2/2002 Benson ..... 403/329
6,408,560 B1 * 6/2002 Bloom ..... 43/12
6,501,010 B2 * 12/2002 Sullivan ..... 84/383 R
6,565,280 B1 * 5/2003 Post ..... 403/325
6,595,713 B1 * 7/2003 Wilson ..... 403/7
6,747,198 B1 * 6/2004 Sullivan ..... 84/383 R
6,854,916 B2 * 2/2005 Hsieh ..... 403/109.3
7,219,386 B2 * 5/2007 Tsuchiya et al. ..... 15/144.4
7,328,822 B2 * 2/2008 Stokes ..... 223/94
7,473,832 B2 * 1/2009 Wanne ..... 84/383 R
2008/0022839 A1 * 1/2008 Sullivan ..... 84/383 R
2008/0083316 A1 * 4/2008 Wanne ..... 84/398
2008/0087159 A1 * 4/2008 Heintz ..... 84/470 R
2009/0193956 A1 * 8/2009 Jean ..... 84/383 A

* cited by examiner

SINGLE REED WOODWIND MUSICAL INSTRUMENT MOUTHPIECE APPARATUS AND METHOD

RELATED APPLICATIONS

This application claims priority of provisional U.S. patent application 60/833,650 filed Jul. 27, 2006 as well as provisional U.S. patent application 60/924,291 filed May 7, 2007 both filed by the same applicant as named herein, namely George V. Sullivan.

FIELD OF THE INVENTION

The invention relates to the field of musical instruments and, in particular, woodwind instruments that utilize a reed, such as clarinets and saxophones, which utilize a moistened reed to produce tones. Such reeds often become unusable and need to be repeatedly changed. Using conventional methods this can be a difficult and time consuming process especially for children and beginners or when needed to be done quickly, such as during an ongoing performance, or with limited lighting. The reed must be properly aligned longitudinally with respect to the mouthpiece in such a manner that a proper tone is produced.

While the invention will be described in terms of a clarinet and has particular application to clarinet methods and apparatus, it will be understood that the present invention has application to all woodwind instruments that have single reeds.

Single-reed instruments use a reed, which is a thinly sliced piece of cane or plastic that is held against the aperture of a mouthpiece with a ligature. When air is forced between the reed and the mouthpiece, the reed vibrates, creating the sound. Single reed instruments include the clarinet and saxophone families of instruments. Single-reed instruments will be understood to not include (1) double-reed instruments and flutes. Double-reed instruments use two precisely cut, small pieces of cane joined together at the base. The finished, bound reed is inserted into the top of the instrument and vibrates as air is forced between the two pieces of bound cane. Flutes produce sound by the user blowing against an edge.

BACKGROUND OF THE INVENTION

The prior art includes U.S. Pat. No. 6,747,198 issued to the applicant herein on Jun. 8, 2004 that describes a reed and mouthpiece assembly for a woodwind instrument, such as a clarinet or saxophone, wherein the reed is formed with a special configuration having a mating shape defined therein which is engageable with respect to a protruding member or members extending outwardly from the generally planar reed mounting surface of the woodwind mouthpiece. A slot or other aperture is defined in the non-vibrating clamped portion of the reed in order to facilitate alignment thereof during mounting with respect to a generally planar reed mounting area of the woodwind mouthpiece. A uniquely configured mouthpiece having a protruding member in combination with a uniquely shaped reed for engagement therewith provides a self-aligning and self-centering reed which is usable with any type of attachment mechanism including conventional ligatures as well as a unique securing device described herein. The engagement between the protruding member and the unique reed provides for faster and easier alignment during reed installation onto a woodwind mouthpiece despite what type of ligature is used. The prior art also includes U.S. Pat. No. 6,501,010 issued to the applicant herein on Dec. 31, 2002.

The invention described therein provides a unique configuration for a reed and mouthpiece for a woodwind instrument wherein the reed is formed with a special configuration having a slot in the non-vibrating clamped portion to facilitate mounting thereof with respect to a uniquely configured mouthpiece of a woodwind instrument such as a clarinet or saxophone. Both patents makes extensive reference to known prior art.

The term "ligature" is commonly defined as something that is used to bind such as a filament (as a thread) used in surgery; something that unites or connects or the action of binding or tying. U.S. Pat. No. 5,648,623 issued to Silverstein et al. on Jul. 15, 1997 asserts that ligatures have been de facto contrivances for securing clarinet and saxophone reeds throughout this century. Two hundred years ago, when the clarinet evolved from the chalumeau, woven cord was used as a ligature on reed instruments. The specialized separate reeds and mouthpiece of the modern clarinet and saxophone must ideally be mated flat surface to flat surface as if they were made of one piece. Such one piece systems occurred in bagpipe and chalumeaux reeds before the arrival of the clarinet and saxophone. In such one piece systems, no ligature was necessary because the reed and mouthpiece were one piece with no flat surfaces needing to be mated under pressure. However, modern convention based upon consistency dictates using separate reeds and mouthpieces. Generally, a mouthpiece will last for years while the reeds warp and wear out in days or weeks.

Ideally, the reed has a precisely planar surface that abuts a precisely planar surface of the mouthpiece.

The installation of a reed in such instruments requires precise relative alignment and positioning of the reed with respect to the mouthpiece as well as the precise relative alignment and positioning of the ligature with respect to the mouthpiece. As indicated above this positioning and alignment is often difficult for the inexperienced or when needed to be done quickly or under inadequate lighting.

SUMMARY OF THE INVENTION

It is an object of the present invention to provide an apparatus and method which will facilitate easy and precise installation of a reed to a single reed woodwind musical instrument mouthpiece and which, more particularly, attaches the ligature to the mouthpiece and thus eliminates the handling of the ligature thereby allowing the reed to be simply inserted under the ligature.

Other objects of the present invention are to provide an assembly and method whereby the physical appearance of the mouthpiece and ligature does not markedly change and to provide an assembly and method whereby the ligature can be easily detached from the mouthpiece to allow the instrument to be used in a conventional manner or for cleaning purposes.

A further object of the present invention is to register the ligature with respect to the mouthpiece in a manner which inherently facilitates the process of installing a replacement reed.

Still another object of the invention is to ensure that the optimum position of the ligature is achieved.

Yet another object of the invention is to provide and apparatus and method that allows replacement of a reed without any movement of the ligature with respect to the mouthpiece.

It has now been found that these and other objects of the present invention may be achieved in a mouthpiece assembly for a woodwind musical instrument that holds an associated reed includes (1) an elongated mouthpiece body defining an air conduit means extending therethrough for providing a supply of air to facilitate playing of a woodwind musical instrument; (2) a reed placement surface defined on the mouthpiece body adjacent the air conduit dimensioned and configured to receive a reed detachably secured thereagainst; (3) a ligature including a ligature body that includes a band dimensioned and configured to encircle the mouthpiece body and selectively retain the associated reed in position upon the reed placement surface and (4) a locating body engaging the ligature body and the mouthpiece body to locate the ligature body axially and radially with respect the mouthpiece body.

In some forms of the invention the ligature includes surfaces dimensioned and configured to cooperate with an associated reed whereby positioning the ligature body with respect to the mouthpiece body also positions the associated reed with respect to the reed placement surface.

On the mouthpiece assembly, the locating body engaging the ligature and the mouthpiece body to locate the ligature axially and radially with respect the mouthpiece body may extend through the ligature body. In some embodiments the locating body extends from the mouthpiece body. The locating body is spring biased from a recess in the mouthpiece body in some embodiments.

In some embodiments of the invention the locating body engaging the ligature and the mouthpiece body to locate the ligature axially and radially with respect the mouthpiece body extends through the ligature body and includes a knob extending through the ligature body into a recess in the mouthpiece body. In some embodiments the knob may be carried on an elongated leaf spring and the leaf spring biases the locating member into engagement with the mouthpiece body. The elongated leaf spring may be fixed to the ligature body.

In still other forms of the invention the locating body, engaging the ligature and the mouthpiece body to locate the ligature axially and radially with respect the mouthpiece body extends through the ligature body, includes a knob extending through the ligature into a recess in the mouthpiece body and the locating body is carried on a lanyard. Some forms of the invention have the lanyard attached to the ligature body.

Other forms of the mouthpiece assembly include a locating body engaging the ligature and the mouthpiece body to locate said ligature axially and radially with respect said mouthpiece body extends through said ligature body, and the locating body is a pin dimensioned and configured to engage a hole in the mouthpiece. In some forms the pin has screw threads meshing with screw threads in the hole in the mouthpiece. The pin may have a head.

The invention also includes the method for mounting a ligature on a mouthpiece for a woodwind musical instrument that holds an associated reed comprising: (1) providing an elongated mouthpiece body defining an air conduit means extending therethrough for providing a supply of air to facilitate playing of a woodwind musical instrument; (2) providing a reed placement surface on the mouthpiece body adjacent the air conduit dimensioned and configured to receive a reed detachably secured thereagainst; (3) providing a ligature including a ligature body dimensioned and configured to encircle the mouthpiece body and selectively retain the associated reed in position upon the reed placement surface and (4) providing a locating body engaging the ligature body and the mouthpiece body to locate the ligature body axially and radially with respect the mouthpiece body.

In some forms of the method the step of providing a locating body engaging the ligature body and the mouthpiece body to locate the ligature body axially and radially with respect the mouthpiece body includes providing a locating body that is spring biased away from the mouthpiece body towards the ligature. The method may include a step of providing a locating body engaging the ligature body and the mouthpiece body to locate the ligature body axially and radially with respect the mouthpiece body includes providing a locating body that is spring biased through the ligature body towards the mouthpiece body.

Other forms of the method may include a step of providing a locating body engaging the ligature body and the mouthpiece body to locate the ligature body axially and radially with respect the mouthpiece body includes providing a locating body that is secured by a lanyard.

BRIEF DESCRIPTION OF THE DRAWING

The invention will be better understood by reference to the accompanying drawing in which.

DESCRIPTION OF THE PREFERRED EMBODIMENTS

The present invention provides a unique configuration for a ligature and mouthpiece assembly for use with woodwind musical instruments. This unigue invention provides an improved means for securing a reed to a mouthpiece which makes changing the reed a simple and easy process especially for children and beginners who often find this activity to be difficult, frustrating and time consuming.

Figure 1:
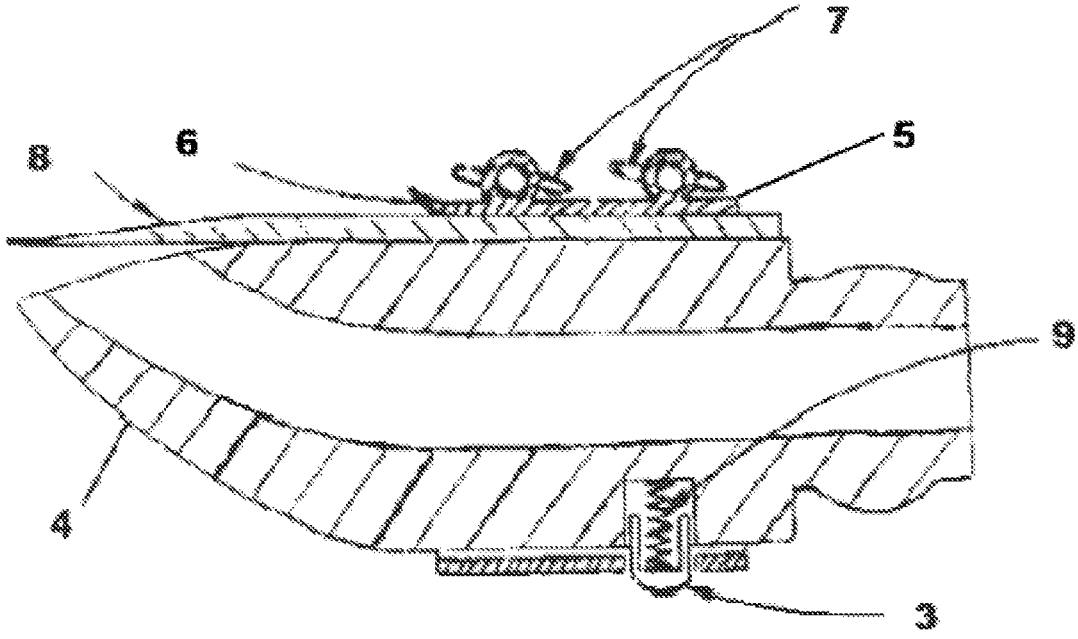
FIG. 1 is an axial cross-section of a first embodiment of the present invention in which a spring-loaded detent engages an aperture in the ligature and thus positions the ligature with respect to the mouthpiece body.
Figure 2:
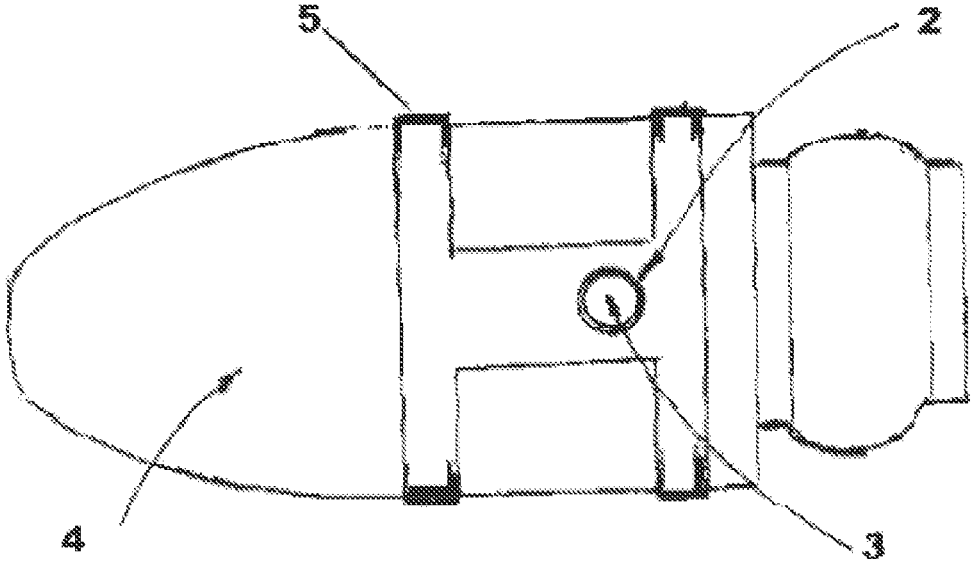
FIG. 2 is a bottom view of the embodiment illustrated in FIG. 1 showing in greater detail the aperture that registers with the detent.
Figure 3:
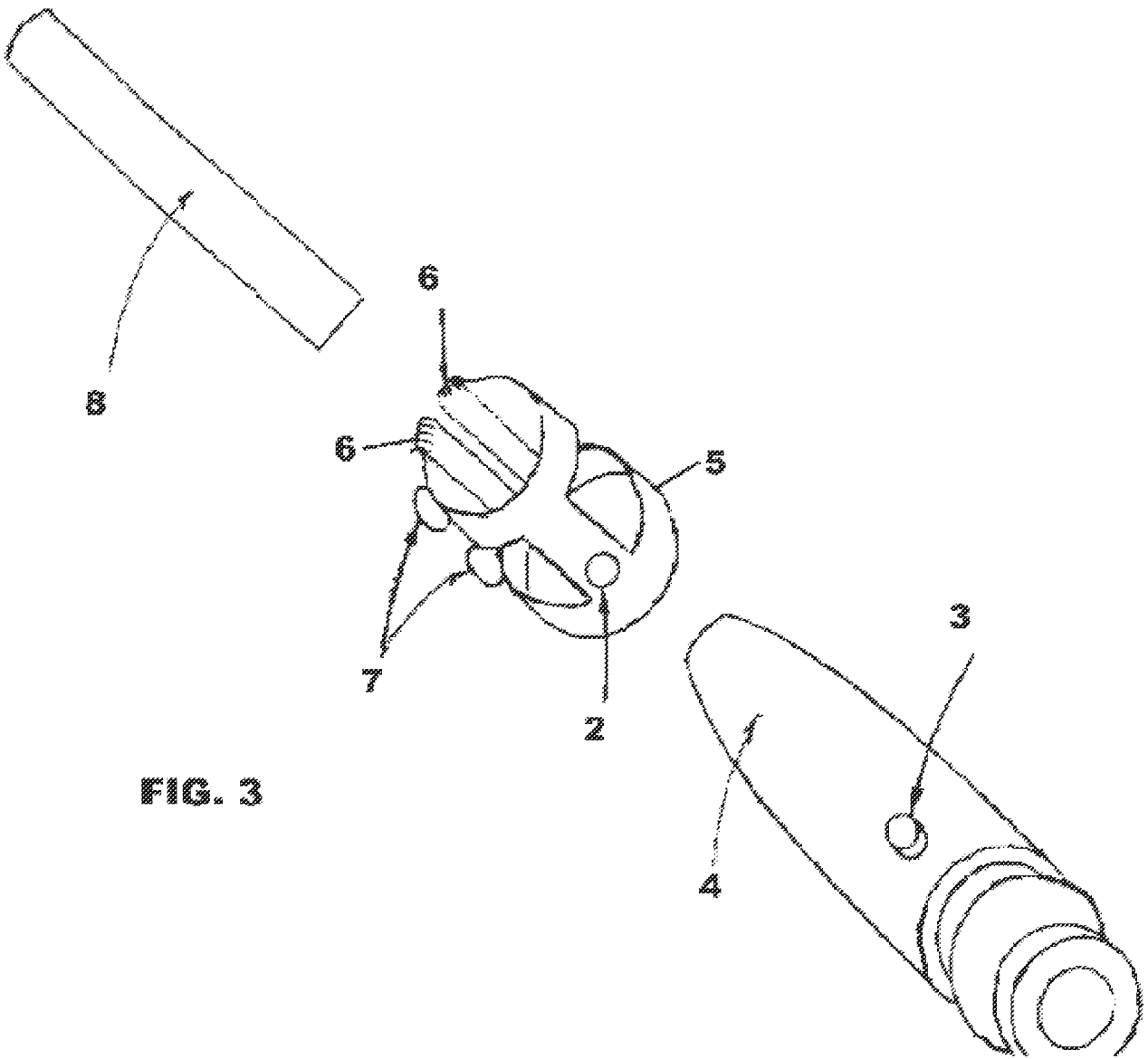
FIG. 3 is an exploded perspective view of the apparatus illustrated in FIGS. 1 and 2.

This invention makes use of a uniquely configured ligature 5 which engages a uniquely configured mouthpiece 4. Referring now to FIGS. 1, 2 and 3 there is shown a first embodiment in which a uniquely configured mouthpiece 4 includes a spring 9 outwardly biasing a protruding member (push button or detent) 3 form the body of the mouthpiece 4. The ligature 5 has a hole 2 in it which engages the protruding member or detent 3 that is of the mouthpiece 5. When the detent 3 is depressed the ligature 5 can pass over the detent 3. When the hole 2 in the ligature 5 is aligned above the protruding member or detent 3 the spring action pushes the protruding member into the hole 2 in the ligature 5 thereby securing as well as registering both axially and radially the ligature 5 to the mouthpiece 4.

Figure 4:
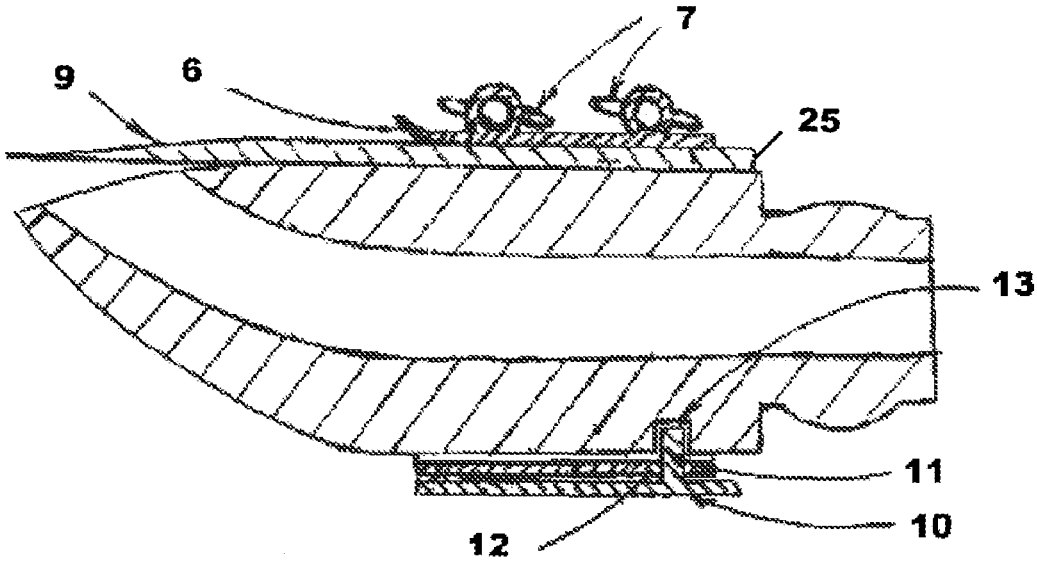
FIG. 4 is a schematic axial cross-section of both second and third embodiments of the present invention characterized in the second embodiment by a leaf spring on which a knob is mounted that registers with a recess in the mouthpiece to achieve registration of the ligature with respect to the mouthpiece. In the third embodiment the leaf spring may be replaced by a flexible arm or lanyard to allow positioning of the knob in the recess of the mouthpiece.
Figure 5:
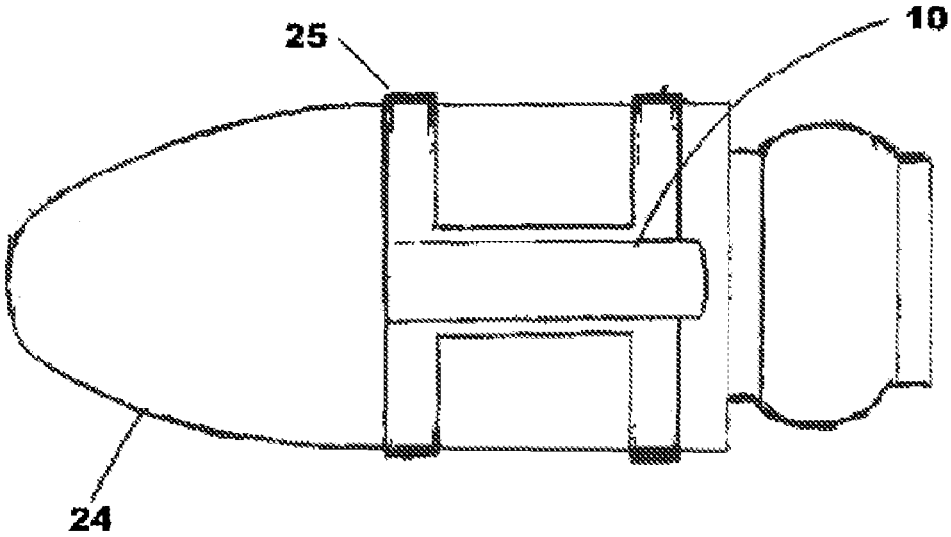
FIG. 5 is a schematic bottom view of the second and third embodiments illustrating the member that may be a leaf spring, flexible arm or lanyard when the knob is engaged in the recess in the mouthpiece.

Referring now to FIGS. 4 and 5 there is shown a second embodiment of the present invention in which the ligature has a flap of flexible spring type material (a leaf spring) 10 affixed to it. More particularly, the flap 10 overlaps a portion of the ligature 25. At one end of the flap 10 is disposed a post or knob 11 which passes through a hole 12 in the ligature 25 and is dimensioned and configured for snug fitting engagement with a hole 13 in the mouthpiece 24. When the post 11 on the flap 10 is positioned over the hole 13 in the mouthpiece 24 the spring tension of the flap 10 forces the post 11 into the hole 13 thereby securing the ligature to the mouthpiece.

Each of the ligatures 5, 25, 35 include a shaped area under and through which the reed 8 extends. This area includes a raised and beveled section 6 at the reed receiving portion of the ligature 5, 25, 35 as well as a shaped surface under which the reed 8 shall pass which will maintain the reed 8 in proper alignment with respect to a reed placement surface on the mouthpiece body. Each ligature 5, 25, 35 is made in such a manner and of such material so that when the ligature screws, which hold the reed 8 in place, are slightly loosened the ligature will quickly relieve tension on the reed 8 thus allowing the reed 8 to be even more easily and quickly installed and removed.

In a variation of the second embodiment, also illustrated by FIGS. 4 and 5 the flap 10 is more flexible and may be better called a lanyard or cord that connects the knob or post 11 to the structure of the ligature 25. The lanyard is also shown in FIGS. 6 and 7.

Figure 6:
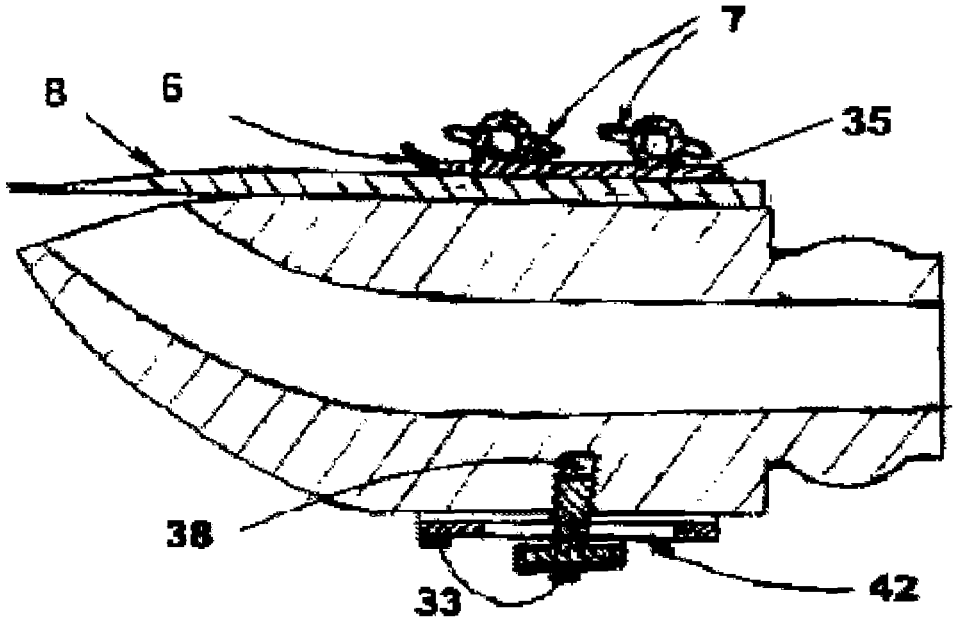
FIGS. 6 and 7, are respectively schematic axial cross-section and bottom views of a fourth embodiment in which a pin or screw couples the ligature to the mouthpiece illustrating a lanyard attached to the pin and ligature.
Figure 7:
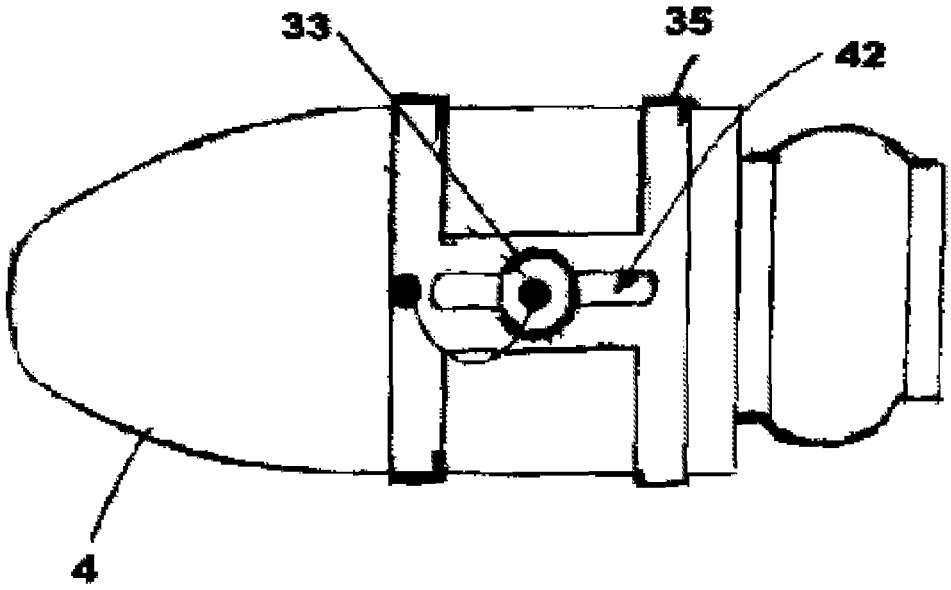
Figure 8:
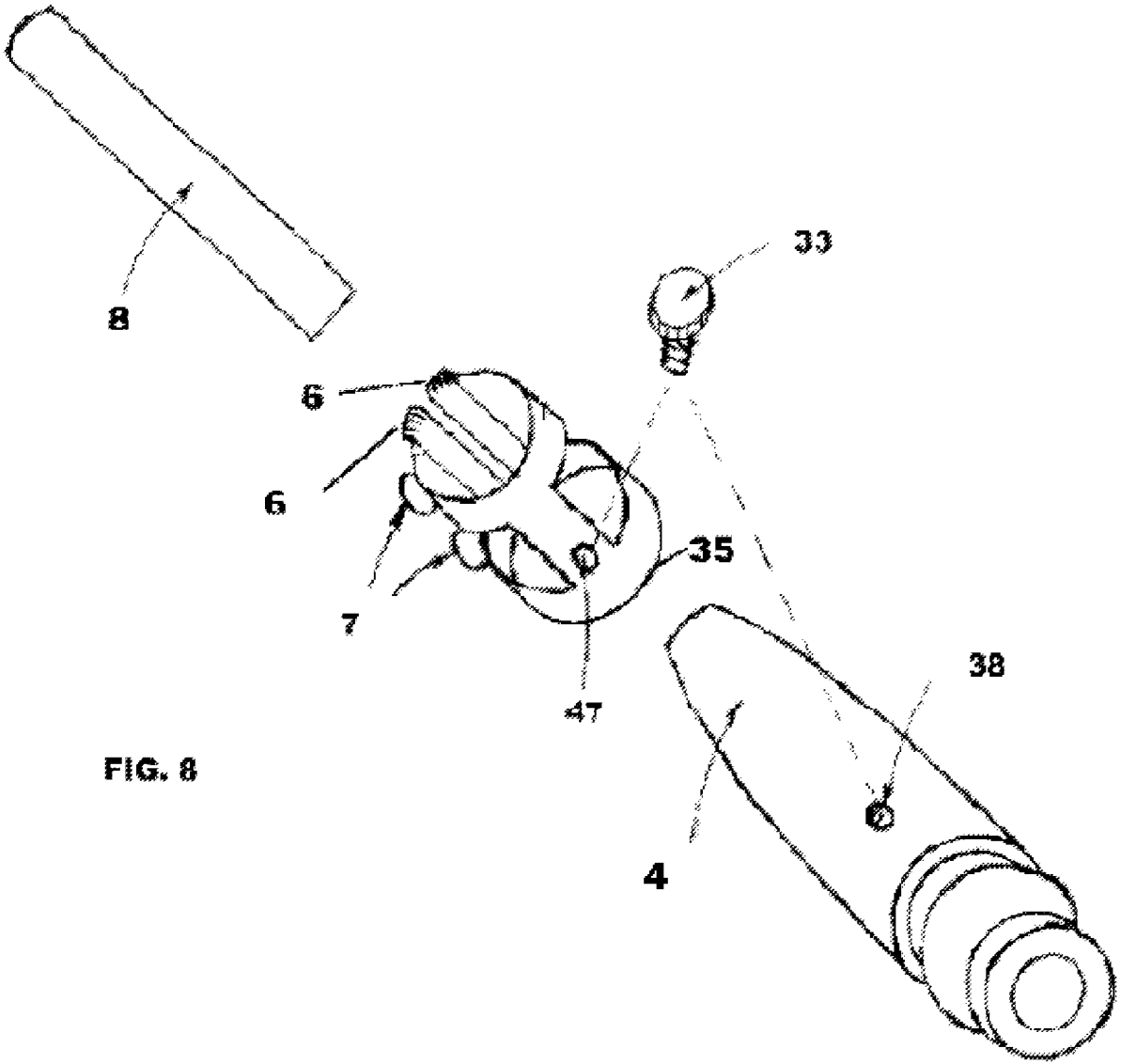
FIG. 8 is an exploded perspective view of a very similar embodiment, and having a circular hole instead of a slot for the pin in the ligature.

Referring now to FIGS. 6-8, there is shown a fourth embodiment that has substantial similarities to the other embodiments. This embodiment includes a ligature 35 having a body that encircles the mouthpiece 4. The ligature 35 includes screws 7 for tightening the ligature with respect to the mouthpiece 4 as in both the prior art and other embodiments of the present invention. As in the other embodiments, the ligature includes beveled portions 6 for engaging the reed 8 to maintain the reed 8 in proper alignment with respect to the mouthpiece. In FIGS. 6 and 7 the body of the ligature 35 includes a slot 42 through which a pin 33 extends. The pin 33 extends into a hole 38 in the mouthpiece 4. Various forms of this embodiment include screw threads disposed on the outer surface of the pin that cooperated with mating threads in the hole 38 in the mouthpiece 4. Some forms of the pin 33 have a head that overlaps a slot in the ligature as illustrated in FIG. 6. Some forms rely on a snug or press fit between the pin 33 and the hole 38. The form of this embodiment show in FIGS. 6 and 7 has the pin 33 extending through a slot 42 in the ligature 35 as noted above, however, the form shown in FIG. 8 has the pin 33 extending through a hole 47.

It will be understood that the apparatus in accordance with the present invention will provide a ligature which once attached to the mouthpiece will not ordinarily be removed with respect to the mouthpiece body. This is in contrast to the traditional approach of having to locate the ligature axially and radially with respect to the mouthpiece body every time the reed 8 is removed and replaced. This invention ensures that the user, such as a child or beginner, will not have to fumble with both the reed and the ligature at the same time and yet have the ligature always located in the correct position for the best tone production. It should be understood that an important feature of the present invention is that if one chooses to use the ligature in the traditional manner the ligature can be easily detached from the mouthpiece and used conventionally.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A mouthpiece assembly for a woodwind musical instrument for selectively retaining a reed which comprises:

A. a mouthpiece body defining an air conduit means extending longitudinally therethrough in order to selectively provide a supply of air to facilitate playing of a woodwind musical instrument when used therewith, said mouthpiece body further defining a reed placement surface positioned adjacent said air conduit means for receiving a reed detachably securable in abutting engagement thereagainst:

B. a ligature assembly for detachably securing of the reed in abutting engagement with respect to said reed placement surface, said ligature assembly including a ligature body extending around said mouthpiece body and the reed in order to selectively retain said reed in detachably engagement with respect to said reed placement surface in position adjacent said air conduit means, said ligature body defining a slot means extending longitudinally therealong; and C. a locating means engageable with respect to said mouthpiece body and positioned extending through said slot means of said ligature body to facilitate positioning of said ligature body axially with respect to said mouthpiece body, said ligature assembly being selectively longitudinally moveable with respect to said mouthpiece body to facilitate adjustable relative positioning therebetween longitudinally to facilitate reed installation and tonal positioning.

2. A mouthpiece assembly for a woodwind musical instrument for selectively retaining a reed as defined in claim 1 wherein said locating means is engageable with respect to said mouthpiece body at a position thereon diametrically oppositely located from the position of said reed placement surface thereof.

3. A mouthpiece assembly for a woodwind musical instrument for selectively retaining a reed as defined in claim 1 wherein said mouthpiece body defines a mounting hole means extending therewithin and wherein said locating means comprises a locating pin means engageable within said mounting hole means and extending outwardly therefrom through said slot means to facilitate axial positioning of said ligature assembly with respect to said mouthpiece body while allowing longitudinally relative movement therebetween to facilitate reed installation and tonal positioning.

4. A mouthpiece assembly for a woodwind musical instrument for selectively retaining a reed as defined in claim 3 wherein said locating pin means is detachably engageable with respect to said mounting hole means defined in said mouthpiece body to allow use of the mouthpiece assembly in a conventional manner if desired by removal of said locating pin means from said mounting hole means.

5. A mouthpiece assembly for a woodwind musical instrument for selectively retaining a reed as defined in claim 4 wherein said mounting hole means includes female thread means therewithin and wherein said locating pin means includes male thread means thereupon mated to said female thread means to selectively secure said ligature body to said mouthpiece body at any position along said slot means and to facilitate detachably engagement of said locating pin means with respect to said mounting hole means.

6. A mouthpiece assembly for a woodwind musical instrument for selectively retaining a reed as defined in claim 4 wherein said locating pin means includes a head means fixedly secured thereto to facilitate placement of said locating pin means into said mounting hole means and to facilitate removal of said locating pin means from said mounting hole means.

7. A mouthpiece assembly for a woodwind musical instrument for selectively retaining a reed as defined in claim 6 wherein said head means includes a serrated peripheral edge surface thereof to facilitate grasping and manipulation thereof.

8. A mouthpiece assembly for a woodwind musical instrument for selectively retaining a reed as defined in claim 7 wherein said serrated peripheral edge surface is circular in shape.

9. A mouthpiece assembly for a woodwind musical instrument for selectively retaining a reed as defined in claim 3 further comprising a lanyard means attached to said locating pin means and attached to said ligature body to facilitate retaining of said locating pin means when disengaged from said mounting hole means defined in said mouthpiece body.

10. A mouthpiece assembly for a woodwind musical instrument for selectively retaining a reed as defined in claim 9 wherein said lanyard means is attached to said ligature body at a position immediately adjacent said slot means defined extending longitudinally therealong.

11. A mouthpiece assembly for a woodwind musical instrument for selectively retaining a reed as defined in claim 9 wherein said lanyard means is flexibly resilient to facilitate selective retaining of said locating pin means.

12. A mouthpiece assembly for a woodwind musical instrument for selectively retaining a reed as defined in claim 1 wherein said ligature assembly means includes a threaded fastening means operative to selectively tighten said ligature assembly in position extending around said mouthpiece body, said threaded fastening means being positioned diametrically oppositely on said ligature assembly means from the position of said slot means extending longitudinally therealong.

13. A mouthpiece assembly for a woodwind musical instrument for selectively retaining a reed as defined in claim 3 wherein said locating pin means extends into said mouthpiece body in a direction extending radially thereinto at a position diametrically oppositely located from the location of said reed placement surface thereof.

14. A mouthpiece assembly for a woodwind musical instrument for selectively retaining a reed as defined in claim 13 wherein said locating pin means extends radially outwardly from said mouthpiece body at a location diametrically oppositely located from said reed placement surface thereof.

15. A mouthpiece assembly for a woodwind musical instrument for selectively retaining a reed which comprises:

A. a mouthpiece body defining an air conduit means extending longitudinally therethrough in order to selectively provide a supply of air to facilitate playing of a woodwind musical instrument when used therewith, said mouthpiece body further including a reed placement surface positioned adjacent said air conduit means for receiving a reed detachably securable in abutting engagement thereagainst, said mouthpiece body further defining a mounting hole means extending therewithin;

B. a ligature assembly for detachably securing of the reed in abutting engagement with respect to said reed placement surface, said ligature assembly including a ligature body extending around said mouthpiece body and the reed in order to selectively retain said reed in detachably engagement with respect to said reed placement surface in position adjacent said air conduit means, said ligature body defining a slot means extending longitudinally therealong, said ligature assembly means including a threaded fastening means operative to selectively tighten said ligature assembly in position extending around said mouthpiece body, said threaded fastening means being positioned diametrically oppositely on said ligature assembly means from the position of said slot means extending longitudinally therealong; and C. a locating means detachably engageable with respect to said mouthpiece body and positioned extending through said slot means of said ligature body to facilitate positioning of said ligature body axially with respect to said mouthpiece body, said ligature body of said ligature assembly being selectively longitudinally moveable with respect to said mouthpiece body to facilitate adjustable relative positioning therebetween longitudinally to facilitate reed installation and tonal positioning, said locating means being engageable with respect to said mouthpiece body at a position thereon diametrically oppositely located from the position of said reed placement surface thereof, said locating means comprising a locating pin means positionable within said mounting hole means and extending outwardly therefrom through said slot means to facilitate axial positioning of said ligature assembly with respect to said mouthpiece body while allowing longitudinally relative movement therebetween, said locating pin means being detachably engageable with respect to said mounting hole means defined in said mouthpiece body to facilitate use of the mouthpiece in a conventional manner if desired by removal of said locating pin means from said mounting hole means.

* * * * *